United States Patent [19]

Haider

[11] Patent Number: 4,840,310

[45] Date of Patent: Jun. 20, 1989

[54] FUEL INJECTION NOZZLE

[75] Inventor: Gottfried Haider, Linz, Austria

[73] Assignee: Voest-Alpine Aktiengesellschaft, Linz, Austria

[21] Appl. No.: 112,495

[22] Filed: Oct. 26, 1987

[30] Foreign Application Priority Data

Oct. 30, 1986 [AT] Austria ..... 2893/86

[51] Int. Cl.[4] ..... F02M 47/00

[52] U.S. Cl. ..... 239/533.4; 239/533.8

[58] Field of Search ..... 239/533.2–533.12

[56] References Cited

U.S. PATENT DOCUMENTS

| | | | |
|---|---|---|---|
| 1,146,557 | 7/1915 | Dieter | 239/533.7 X |
| 3,403,861 | 10/1968 | Eidtmann et al. | 239/533.5 |
| 4,129,256 | 12/1978 | Bader, Jr. et al. | 239/585 X |
| 4,269,360 | 5/1981 | Kopse | 239/533.8 |
| 4,284,049 | 8/1981 | Chmela | 239/533.8 X |
| 4,403,740 | 9/1983 | Ebler et al. | 239/533.4 |
| 4,669,668 | 6/1987 | Ogawa | 239/533.5 |

FOREIGN PATENT DOCUMENTS

| | | | |
|---|---|---|---|
| 487403 | 10/1952 | Canada | 239/533.8 |
| 762041 | 8/1951 | Fed. Rep. of Germany | 239/533.7 |
| 835670 | 4/1952 | Fed. Rep. of Germany | 239/533.7 |
| 2836226 | 3/1979 | Fed. Rep. of Germany | 239/585 |
| 2812519 | 9/1979 | Fed. Rep. of Germany | 239/533.8 |
| 449245 | 6/1949 | Italy | 239/533.3 |
| 491495 | 3/1954 | Italy | 239/533.3 |
| 527630 | 6/1955 | Italy | 239/533.3 |
| 2140505 | 11/1984 | United Kingdom | 239/533.5 |

*Primary Examiner*—Andres Kashnikow

*Attorney, Agent, or Firm*—Cushman, Darby & Cushman

[57] ABSTRACT

In a fuel injection nozzle for an internal combustion engine, a valve needle and a valve needle spring are provided, in which the valve needle can be opened against the force of the valve needle spring (6). In the valve needle spring chamber (8) a displacer piston (7) is arranged so as to overlap the valve needle spring (6), which piston clears a displacing volume after a pre-injection so that the pre-injection is separated from the main injection.

5 Claims, 2 Drawing Sheets

FUEL INJECTION NOZZLE

BACKGROUND OF THE INVENTION

1. Field of the Invention

The invention refers to a fuel injection nozzle for internal combustion engines, especially Diesel engines, comprising a spring-loaded valve needle and a displacer piston sliding with the needle along the same axis against the force of the valve needle spring, in which nozzle the displacer piston and the valve needle are connected with the fuel pressure chamber of an injection pump.

2. Description of the Prior Art

A device according to the above-mentioned type can be taken from DE-OS No. 34 09 924, for example. Providing a displacer piston, which is mounted parallel to the valve needle with regard to the admission of fuel, serves to divide the injection process into a pre-injection and a main injection. For this purpose the valve needle is first lifted against the force of the valve needle spring during a pressure build-up in the fuel pressure line, through which the injection process is initiated. Thereafter also the displacer piston is shifted against the force of the valve needle spring because of the increase of pressure in the pressure line, through which first the force acting on the valve needle spring is increased and second a short decrease of pressure occurs because of the opening displacing volume, which decrease leads to a short shutting of the valve needle. The continuously rising pressure lifts the valve needle once more against the force of the prestressed valve needle spring, thus beginning the main injection.

With the known devices of the initially mentioned type the displacer piston was arranged in a separate component, where this additional component was housed in a series of high-pressure-components being clamped with each other. The additional components resulted in an increase of the length of the nozzle construction and regarding an unfavourable ratio of the aperture cross-section of the piston relative to the guiding cross-section of the piston the pressure relieve taken place relatively slowly with the known devices, especially in the higher speed range. Providing a longer displacer piston would require greater dimensions and would additionally enlarge the inertia of the construction. To limit the height of construction a relatively small ratio of the guiding dameter relative to the guiding length of the displacer piston had to be observed, through which yet again quantities of overflow oil occured and the risk of a tilting and blocking of the displacer piston existed.

Especially when using a monobloc injection pump and nozzle the additional amount of height of construction represents a big disadvantage, the addition height resulting from such an intermediary part.

SUMMARY OF THE INVENTION

The invention aims now at providing a device of the initially mentioned type with which the constructive expenditure is lowered and with which wear and the risk of a tilting of the displacer piston are reduced because of lesser height. For solving this task the arrangement according to the invention is essentially characterized in that the displacer piston is arranged in the valve needle spring chamber and overlaps the valve needle spring in axial direction. Because the displacer piston is arranged in the valve needle spring chamber a separate component for housing the displacer piston can be dropped and because the displacer piston overlaps the valve needle spring in axial direction, a large guiding length can be assured, which counteracts tilting and premature wear of the displacer piston.

The arrangement is advantageously chosen in such a way that the area of the displacer piston overlapping the valve needle spring is at least equal to double the diameter of the displacer piston.

For limiting the stroke of the displacer piston, projecting parts can be arranged in the valve needle spring chamber. In an especially simple way, the nozzle body, following in the direction to the injection bores, can serve as a stop for the displacer piston which results in a very simple construction where no expensive working steps are necessary. The valve needle spring requires always a certain amount of axial length and the necessary space must in no way be enlarged by arranging the displacer piston in the valve needle spring chamber. Altogether, the total height of construction of an additional component for housing the displacer piston is eliminated in this way, through which a compact and simple construction is achieved.

Because of the improvement of the guiding of the displacer piston on the basis of a substantially increased guiding length, a substantially lower leakage is observed.

To assure that oil eventually leaking via the displacer piston does not impair the functioning of the displacer piston, the arrangement is advantageously chosen such that the envelope of the displacer piston overlapping the valve needle spring comprises at least one radial opening in alignment with an overflow oil bore, wherein advantageously the radial opening opens into a circumferential groove at the outer surface of the displacer piston.

For adjusting a favourable cross-sectional ratio of the aperture cross-section of the piston relative to the guiding cross-section of the displacer piston, the construction is advantageously chosen such that the displacer piston is conical at the side facing the fuel pressure chamber and cooperates with a face wall of the valve needle spring chamber, the wall being shaped as a hollow cone and comprising a central bore.

BRIEF DESCRIPTION OF THE DRAWINGS

In the following the invention is explained in greater detail with reference to embodiments shown in the drawing. In it

DESCRIPTION OF THE PREFERRED EMBODIMENTS

Figure 1:
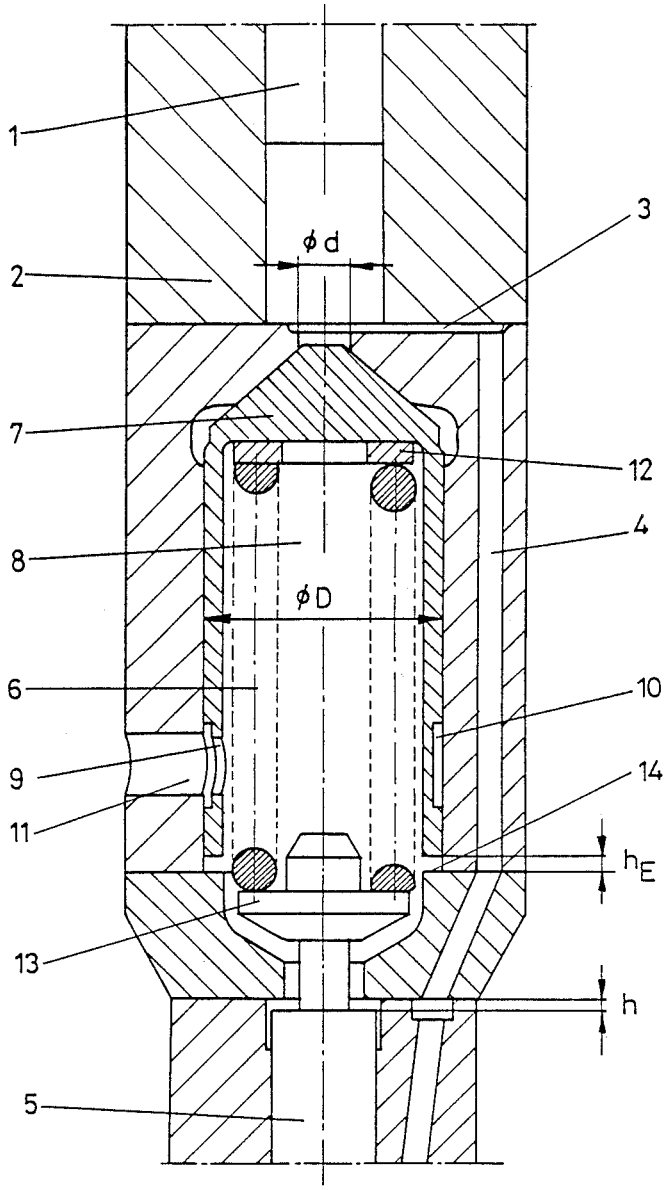
FIG. 1 shows an arrangement according to the invention of a displacer piston in a pump-nozzle-unit and FIG. 2 shows a fuel injection nozzle with the arrangement of the displacer according to the invention.

In FIG. 1 the plunger of a pump-nozzle-unit is designated with 1. During the compression stroke the plunger produces the fuel pressure necessary for the injection in the barrel 2, which fuel reaches the seat of the valve needle 5 via a transverse groove 3 and a bore 4. After reaching a predetermined pressure the valve needle 5 may take off the seat against the force of the valve needle spring 6, with which the pre-injection is started. After a further length of stroke of the plunger 1 the pressure is further rising, after which the built-up pressure moves the displacer piston downwards surmounting the force of the valve needle spring 6. Because of the substantial increase of the diameter between the inlet diameter d and the diameter D of the displacer piston suddenly a large displacing volume is at disposal, which volume is limited by the displacing stroke $h_E$. Simultaneously with the compression of the spring 6 a sudden pressure relief takes place and the valve needle reaches the seat, closing the injection bores. The closing movement of the valve needle 5 being initiated by the pressure decrease in the bore 4 is aided by the additional biasing of the spring 6.

After covering the stroke $h_E$ no further displacing volume is at disposal and the pressure can increase once more until it again surpasses the opening pressure of the valve needle 5. In the following, the main injection takes place after the renewed opening of the valve needle 5.

Leaking oil eventually entering the valve needle spring chamber 8 must be removed to maintain the reliable functioning of the displacer piston 7. For this, the part overlapping the valve needle spring 6 of the envelope of the hollow displacer piston 7 comprises a bore 9 which opens into an annular groove 10 at the outer surface of the displacer piston. The bore 9 as well as the annular groove 10 are in alignment with an overflow oil bore 11 so that with arbitrary angular position of the displacer piston 7 a removing of the leaking oil is assured.

The prestress of the valve needle spring can be adjusted by inserting distance plates 12 into the displacer piston 7. At the end reaching into the valve needle spring chamber 8 the valve needle 5 is provided with a spring plate 13 to be supported against the force of the valve needle spring 6.

The maximal opening stroke of the valve needle is limited by a stop and is designated h. The maximal displacing stroke $h_E$ of the displacer piston 7 is limited by a stop 14 at the bottom of the valve needle spring chamber 8.

The guiding length of the displacer piston 7 is larger than double the guiding diameter D and is positioned to overlap the valve needle spring 6, through which a large change of the cross-section is achieved during opening the displacer piston. In this way also for high speeds an exact separation of pre-injection and main injection is effected. The mass of the piston remains small due to its form of a thin-walled hollow cylinder so that its inertia remains small. The enlarged guiding diameter and the large sealing length simplify the fabrication and improve the high-pressure sealing and the guiding of the displacer piston 7.

Figure 2:
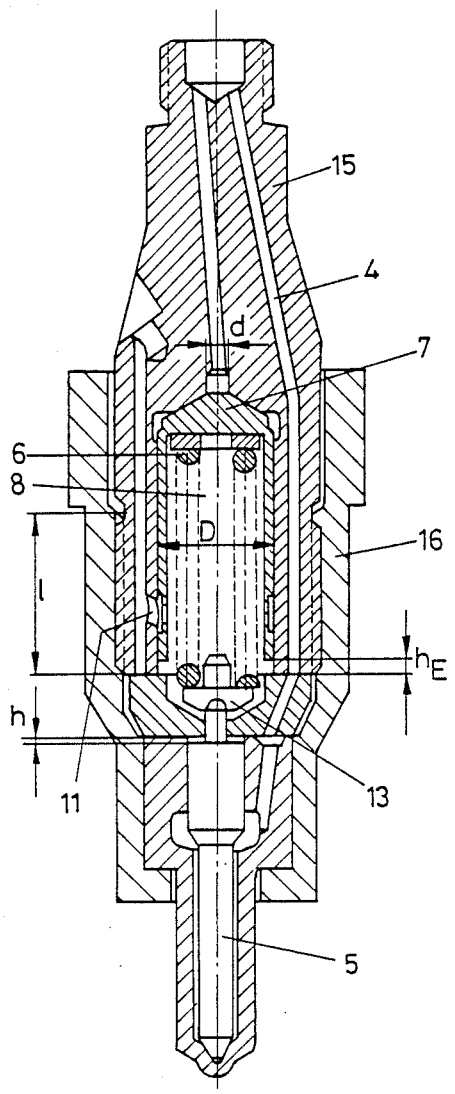

In the embodiment according to FIG. 2 is shown an injector built separately from a pump. The displacer piston 7 is placed in a screwed element 15 and overlaps again the valve needle spring 6. Because of the small number of partition lines between parts being fastened by the screw connection 16 and the screwed element 15 the risk of setting is lowered.

What is claimed is:

1. A fuel injection nozzle for an internal combustion engine, especially a diesel engine, comprising:

a housing means including a longitudinal passage which has an inlet end for connection with a pressurizable fuel chamber of a fuel injection pump, and an outlet end provided with fuel injection bore means;

said longitudinal passage being provided intermediate said inlet and outlet ends, with a longitudinally elongated valve needle spring chamber which is radially enlarged in relation to said longitudinal passage immediately upstream of a seat provided where said longitudinal passage emerges into said valve needle spring chamber;

a fuel delivery bore provided in said housing means, so as to intersect with said longitudinal passage at a first intersection upstream of, and at a second intersection downstream from, said valve needle spring chamber;

a valve needle longitudinally slidably received in said longitudinal passage and having a spring plate thereof disposed in said valve needle spring chamber;

a piston shoulder formed on said valve needle and exposed to said fuel delivery bore via said second intersection, whereby an increase in fuel pressure applied on said piston shoulder can slide said valve needle longitudinally in one direction for moving a tip portion of said valve needle axially away from a closing relation in relation to said fuel injection bore means, and upon a decrease in fuel pressure applied on said piston shoulder can permit said valve needle to slide longitudinally in an opposite direction until said valve needle tip portion closes said fuel injection bore means;

a displacer piston longitudinally slidably received in said valve needle spring chamber, said displacer piston having an end wall capable of closing-off and opening said valve needle spring chamber at said seat;

said displacer piston further including a generally tubular sidewall which extends longitudinally from said end wall towards said spring plate;

a stop means provided for engagement by said sidewall upon longitudinal movement of said end wall away from said seat for limiting longitudinal movement of said end wall away from said seat and thereby limiting volume of a space created in said valve needle spring chamber upstream of said displacer piston;

a compression coil spring received in said valve needle spring chamber, said spring having one end pressed against said displacer piston end wall for tending to maintain said end wall seated against said seat, and another end pressed against said spring plate of said valve needle for tending to maintain said tip portion of said valve needle disposed in closing relation to said fuel injection bore means, whereby said spring longitudinally overlaps with said sidewall of said displacer piston, and, in use, first increment of increased pressure on fuel in said longitudinal passage upstream of said valve needle spring chamber may axially slide said valve needle, against counterpressure provided by said spring, to open said fuel injection bore means for a pre-injection of fuel out of said fuel injection bore means, a second increment of increased pressure on said fuel may longitudinally displace said end wall of said displacer piston, against counterpressure provided by said spring, away from said seat, such movement being limited by said stop means, opening said space, thereby temporarily relieving pressure on said fuel and permitting said spring to temporarily reclose said valve needle against said fuel injection bore means, and a third increment of increased pressure on said fuel may axially slide said valve needle a second time, against counterpressure provided by said spring, to open said fuel injection bore means for injection of fuel out of said fuel injection bore means.

2. The fuel injection nozzle of claim 1, wherein:

said tubular sidewall longitudinally overlaps said spring throughout a distance which is at least twice as long as said displacer piston is wide.

3. The fuel injection nozzle of claim 1, further comprising:

means defining an overflow oil bore through said housing means and communicating with said valve needle spring chamber; and means defining a bore radially through said tubular sidewall of said displacer piston, and means communicating said bore through said sidewall with said overflow oil bore for permitting leaked fluid to be drained from said valve needle spring chamber.

4. The fuel injection nozzle of claim 3, wherein:

said communicating means comprises a circumferentially extending groove externally provided in said tubular sidewall of said displacer piston so as to intersect with said bore through said sidewall.

5. The fuel injection nozzle of claim 1, wherein:

said seat is conically curved, and said end wall of said displacer piston, where capable of closing-off and opening said valve needle spring chamber at said seat is complementarily conically curved.

* * * * *